United States Patent [19]

Meintrup et al.

[11] Patent Number: 4,496,255

[45] Date of Patent: Jan. 29, 1985

[54] INVERTIBLE MULTIPLE-PASS RIBBON CARTRIDGE HAVING TWO CAPSTANS

[75] Inventors: David R. Meintrup, Affton; Janis Dumpis, St. Ann, both of Mo.

[73] Assignee: NEC Corporation, Tokyo, Japan

[21] Appl. No.: 184,098

[22] Filed: Sep. 4, 1980

[51] Int. Cl.[3] ..... B41J 32/00

[52] U.S. Cl. ..... 400/208; 242/199

[58] Field of Search ..... 400/207, 208, 223, 234, 400/235.1, 241.2; 242/197, 198, 199, 200

[56] References Cited

U.S. PATENT DOCUMENTS

| | | | |
|---|---|---|---|
| 2,986,260 | 5/1961 | Whippo | 400/208 |
| 2,989,261 | 6/1961 | Gillette et al. | 242/198 |
| 3,411,731 | 11/1968 | Kelley | 242/199 |
| 3,604,549 | 9/1971 | Caudill et al. | 400/208 |
| 3,901,986 | 8/1975 | Brockett et al. | 400/241.2 X |
| 3,930,099 | 12/1975 | Gregson | 400/241.2 X |
| 3,974,906 | 8/1976 | Lee et al. | 400/208 X |
| 4,011,933 | 3/1977 | Kern | 400/208 |
| 4,034,935 | 7/1977 | Plaza et al. | 400/208 X |
| 4,053,042 | 10/1977 | Hess | 400/234 X |
| 4,264,223 | 4/1981 | Bemis et al. | 242/199 X |

*Primary Examiner*—Ernest T. Wright, Jr.

*Attorney, Agent, or Firm*—Sughrue, Mion, Zinn, Macpeak & Seas

[57] ABSTRACT

A ribbon cartridge for a serial printer includes a casing containing a supply reel, a take-up reel and a ribbon drive roller. A lower axial end of the drive roller is slotted to receive a drive shaft of a ribbon advance motor on the serial printer. The upper axial end of the drive roller is connected by a tension band to the upper end of the take-up reel shaft. The cartridge may be inverted by removing the tension band from the shafts of the drive roller and take-up reel, inverting the cartridge, and replacing the tension band on the shaft of the other reel and the shaft of a drive roller associated with the second reel.

14 Claims, 5 Drawing Figures

FIG. 1.
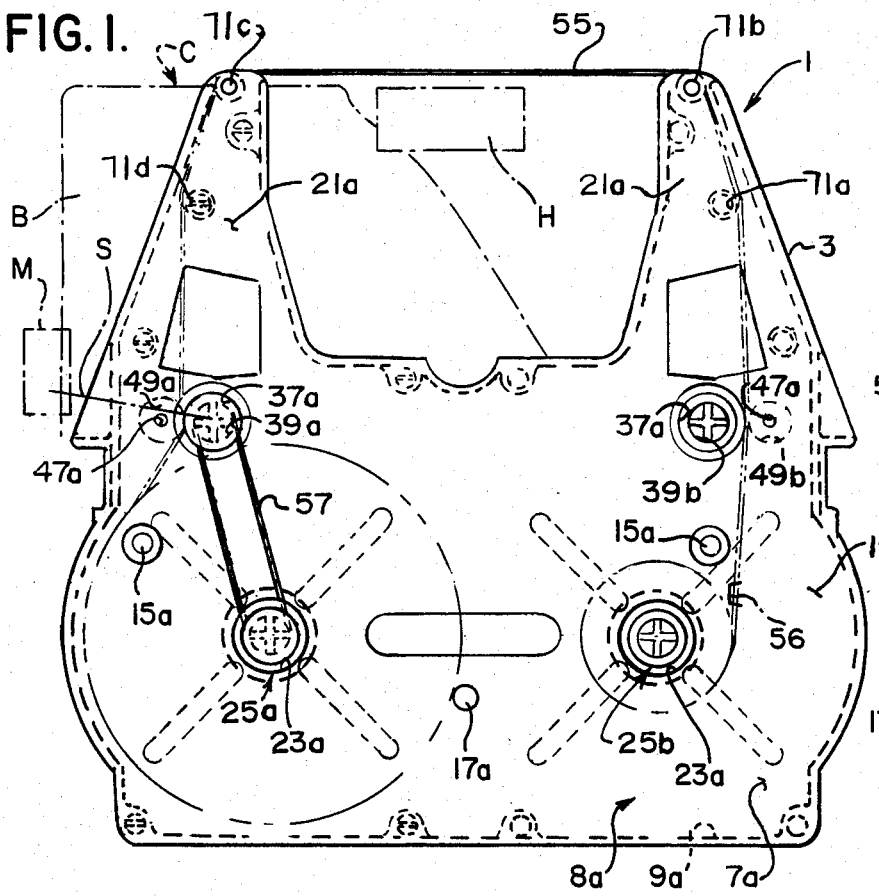
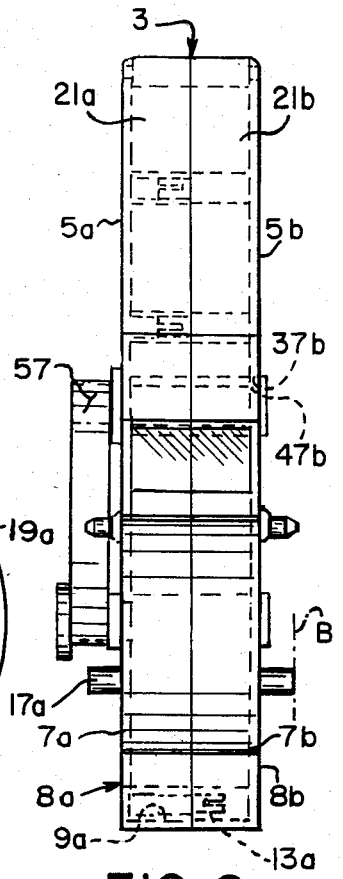
FIG. 2.
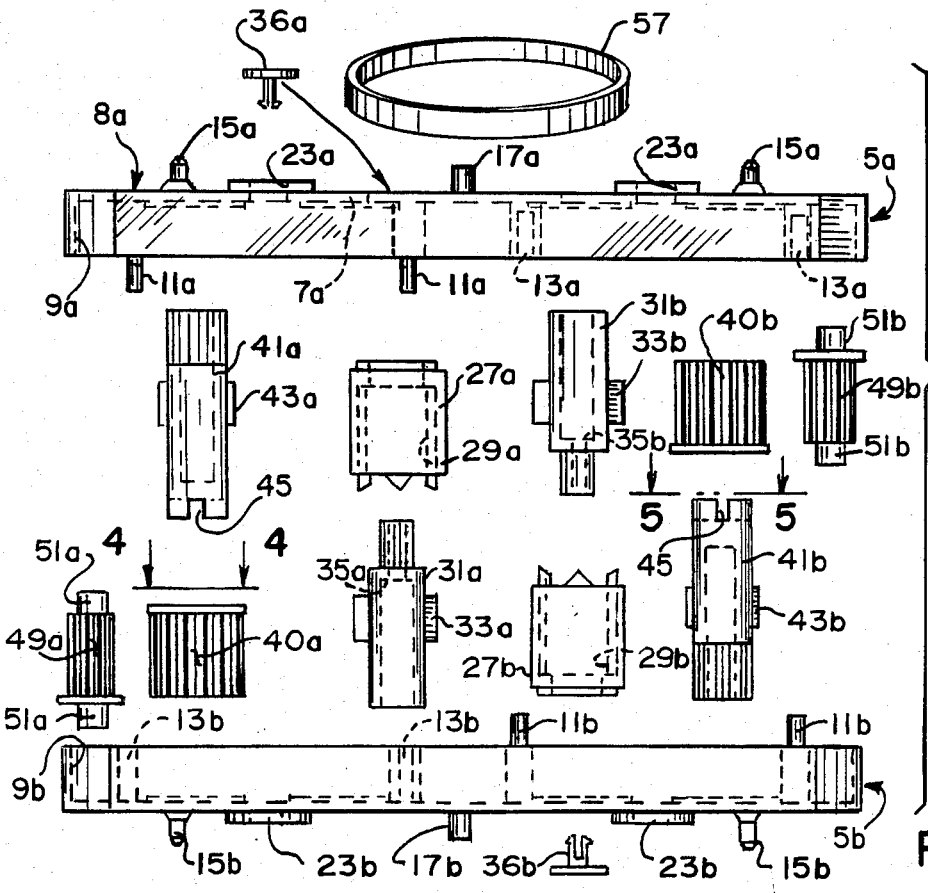
FIG. 3.
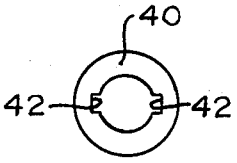
FIG. 4.
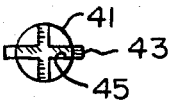
FIG. 5.

INVERTIBLE MULTIPLE-PASS RIBBON CARTRIDGE HAVING TWO CAPSTANS

BACKGROUND OF THE INVENTION

This invention relates to a ribbon cartridge for use in a serial printer. Although it is useful with many ribbons, in the broad sense of webs, tapes, strands and fabric materials, it is particularly well adapted for use with carbon multi-strike solvent film ribbons.

Ribbon cartridges for serial printers, such as typewriters and, more particularly, high speed character printers, are well known. Two types are in general use.

One type, such as the one shown in Whippo, U.S. Pat. No. 2,986,260, includes a pair of spools on which the inked ribbon is wound. Drive spindles on the printer mechanism extend into the hubs of the supply and take-up spools, and the take-up spool is driven directly by its spindle. This arrangement permits the printer to include a mechanism for reversing the direction of ribbon movement when the supply spool has been exhausted by applying power to the spindle through the supply spool and making it the take-up spool. The ribbon may be reused until the ink on the ribbon no longer produces print of acceptable quality. Because the ribbon spools are driven, however, the rate of movement of the ribbon changes as the amount of ribbon on the take-up spool increases, and the tension in the ribbon as it passes the print head is difficult to control. The amount of ribbon in the cartridge is therefore quite limited.

In other cartridges, the printer drive mechanism engages a capstan on the take-up side of the cartridge. The term "capstan" is used broadly herein to include any rotary device outside the take-up reel hub for advancing the inked ribbon.

In some cartridges of the capstan type, such as the cartridges shown in Lee et al, U.S. Pat. No. 3,974,906 and in Hess, U.S. Pat. No. 4,053,042, the ribbon is an endless band packed randomly in the cartridge. These cartridges are typically limited to fabric ribbons, however, and also hold a limited amount of ribbon.

Other capstan-type cartridges, such as the one shown in Kern, U.S. Pat. No. 4,011,933, include a take-up spool and a supply spool for the inked ribbon. The take-up spool is driven indirectly by an elastic band extending between the capstan and the hub of the take-up spool outside of the cartridge's casing. Such cartridges allow tight packing of film-type ribbon on the spools and provide good print quality, but they are of the single-pass variety and must be discarded or reloaded with ribbon after all of the ribbon has been transferred from the supply spool to the take-up spool. These cartridges also utilize a complex ribbon path because of the tensioning devices utilized and, in some cases, because the supply spool and the take-up reel are not co-planar.

The one-pass capstan-type cartridges also do not take full advantage of present film ribbon technology. The ink on present carbon multi-strike solvent film ribbons is micro-encapsulated in a sponge-like coating on the film substrate. When struck, the coating release a certain amount of ink along the outlines of the character of the element striking the film. The carrier then returns to its original state and reabsorbs ink from the surrounding area. This technology theoretically allows the ribbon to produce five or more impressions per print position. The drive systems of present capstan-type cartridges advance the ribbon about one fourth of a character each time the ribbon is struck. They can not be made to drive the ribbon more slowly because of mechanical limitations in the system. Moreover, because the carrier recovers slowly (on the order of five to ten minutes), the impression made by four consecutive strokes (at rates on the order of fifty-five strokes per second) is not as good as if the ribbon were allowed a significant recovery time before the same area is struck by the print element.

The one-pass capstan-type cartridges also are limited in the size of the character they can produce and are prone to splitting from the edge because of the tensioning design of the cartridge and the proximity of the print element to the edge. In addition, the up and down movement of the cartridge carriage on carriage returns sometimes causes the edge of the ribbon to hang up on a bent "petal" of the print element. Once nicked by the element, the ribbon tears quickly when tension is applied to it. Any splitting or tearing of the ribbon renders it useless, and the cartridge is discarded.

SUMMARY OF THE INVENTION

One of the objects of this invention is to provide a serial printer ribbon cartridge of the capstan-drive type which has a longer life than presently known cartridges.

Another object is to provide such a cartridge which is capable of producing higher quality printing than presently known cartridges.

Another object is to provide such a cartridge which is simple in construction and assembly and which utilizes a simple ribbon path.

Another object is to provide such a cartridge which may be capable of printing oversized characters and which is not prone to splitting.

Other objects will occur to those skilled in the art in light of the following description and accompanying drawing.

In accordance with this invention, generally stated, a capstan-drive type of cartridge is provided for a serial printer which includes a cartridge casing having two broad faces, a pair of ribbon spools in the casing, capstan means associated with each of the ribbon spools for advancing the ribbon, means on one of the capstan means extending through one of the broad faces of the casing for interconnection with a drive means on the printer, and means on the other of the capstan means extending through the other of the broad faces of the casing for interconnection with the same drive means when the casing is inverted.

In the preferred embodiment, the capstan means is driven from below the cartridge, and the driven capstan means is connected to the hub of the take-up spool by an elastic band on the upper side of the casing, as in conventional capstan cartridges adapted for use on a Diablo Hytype II brand serial printer manufactured by the Xerox Corporation. In accordance with the preferred embodiment of the present invention, the hubs of both spools and at least part of the capstan means associated with them are formed as sleeves trapped inside the cartridge and shafts slidable within the sleeves. Each shaft is movable from a first position in which one end of the shaft extends above the first broad face of the cartridge to a second position in which the other end of the shaft extends above the other broad face of the cartridge. In a first position of the cartridge, all four shafts extend above the first broad face of the cartridge, and the shafts of the take-up hub and its associated capstan means are connected by an elastic drive belt. When the supply reel is exhausted, the drive belt is removed from these shafts, the cartridge is inverted and replaced on the printer, and the drive belt is replaced on the shaft of the new take-up hub (formerly the supply hub) and the shaft of its associated capstan means.

In the preferred embodiment, the capstan means includes a capstan gear and an engagement gear. The engagement gear rotates around a fixed axis, and the ribbon is meshed between the capstan gear and the engagement gear on both the take-up and supply side of the cartridge. On the take-up side, the capstan gear and the engagement gear pull the ribbon the required distance each time the drive mechanism in the printer turns. The capstan means therefore does not require the delicate spring of present cartridge capstan means and it also aids in the proper repositioning of the micro-encapsulated ink of carbon solvent film ribbon. On the supply side, an identical capstan gear and engagement gear provide the proper drag for tensioning the ribbon. The cartridge therefore does not require the delicate tensioning devices of present cartridges.

Also in the preferred embodiment, the drive belt is a broad, flat elastic band rather than the O-ring now used. This belt gives more positive drive than the O-ring, and permits the use of a greater mass of ribbon in the cartridge. In the preferred embodiment, the width of the ribbon is on the order of ½ inch (plus or minus 1/16 inch), or more than twice the width of present ribbons in capstan type reel-to-reel cartridges.

Also in the preferred embodiment, means are provided on the rear of the cartridge (i.e. the part of the cartridge remote from the reach of ribbon struck by the print element) for raising the rear of the cartridge and lowering the reach of ribbon at the front of the cartridge sufficiently to prevent the print element from striking too close to the edge of the ribbon and splitting it.

Also in the preferred embodiment, the capstan is so sized that the ribbon is pulled through the cartridge much more quickly than through present cartridges, preferably at a rate which provides one character per ribbon position. The quality of the print is thereby greatly improved, and the sponge-like carrier is allowed the necessary time to expand and redistribute the micro-encapsulated ink fully before the ribbon is reused.

Also in the preferred embodiment, the cartridge is highly symmetrical. The casing is formed of two identical halves, having pegs on one side and sockets on the other to provide a friction fit between the two halves. The ribbon spools are coplanar, and the ribbon path is the same on both sides of the cartridge.

Other aspects of the invention will be better understood in light of the following description of the preferred embodiment.

BRIEF DESCRIPTION OF THE DRAWING

In the drawing,

FIG. 1 is a top plan view of one illustrative embodiment of ribbon cartridge for a serial printer in accordance with the present invention.

FIG. 2 is a view in right side elevation of the cartridge of FIG. 1.

FIG. 3 is an exploded view showing parts of the cartridge of FIGS. 1 and 2.

FIG. 4 is a top plan view of a sleeve part of the cartridge of FIGS. 1-3 as shown by section line 4—4 in FIG. 3.

FIG. 5 is a top plan view of a shaft part which cooperates with the sleeve part of FIG. 4 as shown by section line 5—5 in FIG. 3.

DESCRIPTION OF THE PREFERRED EMBODIMENT

Referring now to the drawing for one illustrative embodiment of a cartridge of the present invention, reference numeral 1 indicates a presently preferred cartridge in accordance with the present invention. The cartridge 1 is adapted for use in a Diablo HyType II serial printer of the type illustrated in Lee et al. U.S. Pat. No. 3,974,906. Such printers include a carriage C having a bed B on which is mounted a print head H and a ribbon advance motor M having a drive shaft S. These elements are conventional.

The cartridge 1 includes a casing 3 made up of two identical cover portions 5*a* and 5*b*. The upper cover portion 5*a* includes a broad wall 7*a*, defining an upper broad face 8*a* of the cartridge 1, an upstanding peripheral wall 9*a*, a plurality of pegs 11*a* on its left side, and a plurality of holes 13*a* on its right side. The holes 13*a* are mirror images of the pegs 11*a*. On its upper face 8*a*, the upper cover portion 5*a* includes a pair of standard positioning pegs 15*a* and a lifting peg 17*a*, the purpose of which will be described hereinafter. The upper wall 7*a* of the upper cover portion 5*a* includes the usual body portion 19*a* for receiving spools of ribbon 55 and the usual arms 21*a* for positioning a section or reach of ribbon 55 to be struck by the print head H, as described hereinafter.

The lower cover portion 5*b* is identical with the upper cover portion 5*a*, and is inverted. Identical reference numerals with suffix b are used herein to identify corresponding parts of the lower cover portion 5*b*, and reference numerals without suffixes will be used generically in this description.

The pegs 11 and holes 13 of the upper and lower cover portions 5 mate to hold the casing 3 together by a friction fit.

Each cover portion 5*a* and 5*b* includes a pair of circular openings 23*a* and 23*b* adapted to receive between them a first hub assembly 25*a* and a second hub assembly 25*b*.

Each hub assembly 25*a* and 25*b* includes a sleeve part 27 having a pair of opposed keyways 29 on its inner surface. The keyways 29 extend nearly, but not completely, the axial length of the sleeve part 27. Within each sleeve part 27 is a shaft 31 having splines 33 cooperative with the keyways 29 in the sleeve 27. The length of the splines 33 is chosen to permit the shaft 31 to move to a first position in which a lower end of the shaft 31 is substantially flush with a first face 8 of the cartridge 1 and the upper end of the shaft 31 extends about ¼ inch above the other face 8 of the cartridge 1, to a second position in which the lower end of the shaft 31 extends about ⅜ inch above the first face 8 and the upper end of the shaft 31 is substantially flush with the other face 8 of the cartridge 1. The upper end of each shaft 31 is knurled and is of reduced diameter. Preferably the diameter of the upper end of the shaft 31 is about 174 inch. The shaft 31 is hollow, and the inner face of the shaft 31 includes a step 35 adjacent one end of the shaft 31. A cap 36 is snapped into one end of the shaft 31 and is held in place by the step 35.

The first hub assembly 25*b* is assembled with the upper end of the shaft 31 extending through the upper cover portion 5*a*, and the second hub assembly 25*b* is assembled with the upper end of the shaft 31 extending through the lower cover portion 5*b*.

A second pair of holes 37*a* and 37*b* is provided in each of the cover portions 5*a* and 5*b*. Mounted in the openings 37*a* and 37*b* are capstan drive gear assemblies 39*a* and 39*b* respectively. Each capstan gear assembly 39*a* and 39*b* is similar to its associated hub assembly 25*a* and 25*b*, and each is mounted in the same orientation as its corresponding hub assembly 25.

Each capstan drive gear assembly 39 includes a gear sleeve 40 having a pair of opposed keyways 42 on its inner surface. The keyways 42 extend the full axial length of the gear sleeve 40. The gear sleeve 40 has a diameter of $\frac{5}{8}$ inch and has thirty teeth at a twenty degree pitch angle. The teeth give the sleeve 40 an effective circumference of about two and one-half inches. Within each sleeve 40 is a shaft 41 having splines 43 cooperative with the keyways 42 in the sleeve 40. The upper end of each shaft 41 is about $\frac{3}{8}$ inch in diameter. The lower end of the shaft 41 includes a cruciform slot 45 for interconnection with a drive shaft S on a ribbon advance motor M in the printer.

The length of the splines 43 of the shaft 41 is chosen to permit the first shaft 41*a* to move to a first position in which a lower end of the shaft 41*a* is substantially flush with the broad lower face 8*b* of the cartridge 1 and the upper end of the shaft 41*a* extends about $\frac{3}{8}$ inch above the upper face 8*a* of the cartridge 1, and to a second position in which the lower end of the shaft 41*a* extends about $\frac{3}{8}$ inch beyond the lower face 8*b* and the upper end of the shaft 41*a* is substantially flush with the upper face 8*a* of the cartridge 1. The second shaft 41*b* is permitted to move correspondingly.

Adjacent the openings 37*a* and 37*b* are circular openings 47*a* and 47*b*, which hold the ends of axles 51*a* and 51*b* of engagement gears 49*a* and 49*b*. The engagement gears 49*a* and 49*b* are about $\frac{1}{4}$ inch in diameter and are provided with twelve teeth having twenty degree pitch angles. Each engagement gear 49 intermeshes with its corresponding capstan drive gear 39 loosely enough to accomodate a ribbon 55.

A one-half inch carbon multi-strike solvent film ribbon 55 is wound on the second hub assembly 25*b*, *between the sleeve 40b* of the capstan drive gear assembly 37*b* and engagement gear 49*b*, around posts 71*a* and 71*b* defined by pins 11*b* and holes 13*a*, through an opening at the distal end of the right arm 21, in an unsupported reach across the space between the right and left arms 21, through an opening in the left arm 21, around posts 71*c* and 71*d* defined by pins 11*a* and holes 13*b*, between the sleeve 40*a* of the capstan drive gear assembly 37*a* and engagement gear 49*a*, and onto the hub assembly 25*a*. The ribbon 55 is about three hundred feet long. It will be seen that the ribbon 55 is wound symmetrically from the outside of both hub assemblies 25, so that the ribbon paths on the two sides of the cartridges 1 are mirror images. A conventional end-of-tape marker in the form of a piece of reflective tape 56 is attached near both ends of the ribbon 55.

A flat elastic drive band 57 connects the protruding ends of the shaft 31*a* of the hub assembly 25*a* and the shaft 41*a* of the capstan drive gear assembly 39*a* when the cartridge 1 is in the position shown in FIG. 1. The band 57 is preferably made of rubber and has a flat length of about two inches, slightly less than the outside-to-outside distance between the shafts 31*a* and 41*a*. The knurling on the shafts 31*a* and 41*a* provides a good frictional drive, while allowing the slippage necessary to accommodate the changing size of the roll of ribbon 55 on the hub assembly 25*a*.

The cartridge 1 is assembled by placing, in their respective openings 37*b*, 47*b* and 23*b* in the lower cover portion 5*b*, the sleeves 40 and shafts 41 of the capstan assemblies 39, the engagement gears 49, and the sleeves 27 and shafts 31 of the hub assemblies 25. The ribbon 55 is preferably wound on the hub assemblies 25 before they are placed in the casing 3, and the reach of ribbon 55 between the hub assemblies 25 is then properly positioned. The upper cover portion 5*a* is snapped onto the lower portion 5*b*, and the caps 36 are snapped into the ends of the shafts 31. The drive band 57 is stretched over the posts 31*a* and 41*a* and is prevented from slipping off by the caps 36. It will be seen that the cartridge 1 contains fewer parts than a conventional reel-to-reel, capstan-driven cartridge and is easier to assemble than a conventional cartridge.

The assembled cartridge 1 is placed on the carriage C of a conventional serial printer. The lifting peg 17 engages the bed B of the printer and pivots the lower edge of the exposed reach of ribbon 55 somewhat lower than it would otherwise be. This positioning of the ribbon 55 insures that a smooth portion of the ribbon 55 is struck by the print head H and that even double underscores are spaced away from the lower edge of the ribbon 55.

Upon initiation of print commands to the printer, the ribbon advance motor M is driven counterclockwise, causing the capstan drive gear 39*a* to be driven slowly counterclockwise. The counterclockwise rotation of the capstan drive gear 39*a* squeezes the ribon 55 between the teeth of the engagement gear 49*a* and the capstan drive gear 39*a*. The capstan means composed of the gears 39*a* and 49*a* therefore drives the ribbon 55 smoothly and positively and serves the further function of aiding in the redistribution of microencapsulated ink on the ribbon 55. The effective diameter of the gear sleeve 40 is chosen so that each character printed on the ribbon 55 is spaced from its neighbor, rather than allowing overlap of the characters. The drive band 57 drives the take-up hub assembly 25*a* at a rate sufficient to maintain a tight wrap of the ribbon 55 on the hub assembly 25*a*, but it is permitted sufficient slip to prevent undue tensioning of the ribbon 55 on the hub assembly 25*a*, even as the size of the take-up roll reaches its maximum.

The necessary tension in the unsupported reach of ribbon 55 between the arms 21 is provided by a hold-back force on the supply spool side of the cartridge 1. The hold-back force is generated by the engagement gear 49*b* and the capstan drive gear 39*b* by the motion of the ribbon 55, which provides sufficient drag to tension the ribbon 55.

When the end-of-tape marker 56 is reached, the printer automatically stops. The cartridge 1 is removed from the printer. The drive band 57 is removed from the shafts 31*a* and 41*a*. The cartridge 1 is inverted and replaced on the printer, thereby raising all four of the shafts 31 and 41 above the now upper face 8*b* of the cartridge 1. The band 57 is placed on the shafts 31*b* and 41*b* of the capstan drive gear 39*b* and the engagement gear 49*b*, and the printer is ready to print on a portion of the ribbon 55 which was not printed upon in the first pass of the ribbon 55. This arrangement ensures ample time for the microencapsulated ink on the ribbon 55 to fill the voids where it was previously struck, and doubles the effective amount of available ribbon 55 on a single cartridge 1. As print commands are given to the printer, the turning of the capstan drive gear 39*b* and engagement gear 49*b* provides a positive drive, and the capstan drive gear 39*a* and engagement gear 49*a* provide proper hold-back for tensioning.

Numerous variations in the cartridge 1 of the present invention, within the scope of the appended claims, will occur to those skilled in the art in light of the foregoing disclosure. Merely by way of example, the floating shafts 31 and sleeves 27 may be made a single piece, and the shafts 41 of the capstan means may be made flush with the outer faces 8 of the cartridge 1, if the connecting means between the shafts were made a separate assembly. The connecting assembly could, for example, consist of a frame carrying a pair of sheaves connected by an elastic band or an idler wheel, with each sheave carrying a connector for engaging a slot in the upper end of the cartridge shaft. In this way, the ends of the shafts could be made identical and the connecting assembly need not be supplied with each cartridge. Entirely other drive means may be provided for transmitting power to the take-up spool, and such means may be preferred for cartridges adapted for use with other serial printers. For example, Qume brand printers have an internal drive for the take-up spool and require no external connecting means. In other cases, a take-up spool drive may be internal to the cartridge, and may be similar to the drive system used in data cartridge tape systems manufactured by 3M Company. The width of the ribbon 55 could, if desired, be made a single width, and the amount of travel for each character could be reduced, if desired, although these changes will reduce some of the advantages of the cartridge. These variations are merely illustrative.

We claim:

1. A ribbon cartridge for use in a serial printer, said cartridge comprising a casing having two opposed broad faces, two ribbon spools in said casing, and an inked ribbon wound on said spools and including a reach extending out of said casing between said spools for engagement by a print head in the serial printer, characterized in that said cartridge further comprises two capstans spaced from said spools, said capstans being spaced laterally apart from one another, one of said capstans being associated with each of said ribbon spools for alternatively advancing said ribbon toward its associated spool, first means on a first of said capstans for interconnection with a drive means in the printer to transmit rotational power through a first of said broad faces of said casing, and second means on the second of said capstans for interconnection with the drive means in the printer to transmit rotational power through the second of said broad faces of said casing when said cartridge is inverted.

2. The cartridge of claim 1 wherein said ribbon is a carbon solvent film ribbon having micro-encapsulated ink on a flexible substrate, and wherein each said capstan comprises means for advancing the ribbon a full character each time the ribbon is struck by a print head of the printer, said means for advancing the ribbon comprising a capstan drive wheel having an effective diameter of at least about $\frac{5}{8}$ inch.

3. A ribbon cartridge for use in a serial printer, said cartridge comprising a casing having two opposed broad faces, two ribbon spools in said casing, and an inked ribbon wound on said spools and including a reach extending out of said casing between said spools for engagement by a print head in the serial printer, characterized in that said cartridge further comprises two capstans, one associated with each of said ribbon spools, for alternatively advancing said ribbon toward its associated spool, first means on a first of said capstans for interconnection with a drive means in the printer to transmit rotational power through a first of said broad faces of said casing, and second means on the second of said capstans for interconnection with the drive means in the printer to transmit rotational power through the second of said broad faces of said casing when said cartridge is inverted, each of said capstans including a capstan sleeve positioned between said two broad faces of said casing and a capstan stem extending through said capstan sleeve, said capstan stem being slidable in said capstan sleeve from a position in which said capstan stem extends through said first face of said casing to a second position in which said capstan stem extends through said second face of said casing.

4. The cartridge of claim 3 wherein each of said ribbon spools includes a hub, said hub including a spool sleeve positioned between said two broad faces of said casing and a spool stem extending through said spool sleeve, said spool stem being slidable in said spool sleeve from a position in which said spool stem extends through said first face of said casing to a second position in which said spool stem extends through said second face of said casing.

5. The cartridge of claim 4 including connection means connected between the extended portions of one said capstan stem and its associated said spool stem adjacent one of said faces of said cartridge.

6. The cartridge of claim 5 wherein said connection means comprise a broad, flat elastic drive belt.

7. The cartridge of claim 3 wherein each said capstan comprises a capstan gear and a meshing engagement gear.

8. The cartridge of claim 3 wherein said ribbon has a width of $\frac{1}{2}$ inch plus or minus $\frac{1}{8}$ inch.

9. The cartridge of claim 8 wherein both of said faces of said cartridge include means for raising an end of said cartridge at least about $\frac{1}{8}$ inch.

10. The cartridge of claim 3 wherein said casing is formed of two identical halves, having pegs on one side and sockets on the other to provide a friction fit between the two halves.

11. The cartridge of claim 3 wherein said ribbon spools are coplanar, and wherein the ribbon path is the same on both sides of the cartridge.

12. A ribbon cartridge for a serial character printer having a print head and a ribbon advance mechanism, said cartridge comprising a carbon solvent film ribbon having micro-encapsulated ink on a flexible substrate, a casing having two opposed broad faces, two ribbon spools in said casing, said ribbon being wound on said spools, a pair of openings in said cartridge, a length of said ribbon extending outside of said cartridge between said openings for engagement by said print head, advance means in said casing for advancing said ribbon in response to movement of said advance mechanism in said printer, characterized in that said advance means in said cartridge include means cooperative with said advance mechanism in said printer for advancing said length of ribbon at least one character width each time said ribbon is struck, said advance means comprising two capstans spaced from said spools, said capstans being spaced laterally apart from one another, one of said capstans being associated with each of said ribbon spools for alternatively advancing said ribbon toward its associated spool, and multi-pass means for passing at least the major part of the length of said ribbon between said openings a plurality of times, said multipass means comprising first means on a first of said capstans for interconnection with the drive mechanism in the printer to transmit rotational power through a first of said broad faces of said casing, and second means on the second of said capstans for interconnection with the drive mechanism in the printer to transmit rotational power through the second of said broad faces of said casing when said cartridge is inverted.

13. The cartridge of claim 12 wherein said ribbon has a width of $\frac{1}{2}$ inch plus or minus $\frac{1}{8}$ inch.

14. A ribbon cartridge for use in a serial printer, said cartridge comprising a casing having two opposed broad faces, two ribbon spools in said casing for receiving an inked ribbon for winding on said spools and including a reach extending out of said casing between said spools for engagement by a print head in the serial printer, characterized in that said cartridge further comprises two capstans spaced from said spools, said capstans being spaced laterally apart from one another, one of said capstans being associated with each of said ribbon spools for alternatively advancing said ribbon toward its associated spool, first means on a first of said capstans for interconnection with a drive means in the printer to transmit rotations power through a first of said broad faces of said casing, and second means on the second of said capstans for interconnection with the drive means in the printer to transmit rotational power through the second of said broad faces of said casing when said cartridge is inverted.

* * * * *

UNITED STATES PATENT AND TRADEMARK OFFICE

CERTIFICATE OF CORRECTION

PATENT NO. : 4,496,255

DATED : January 29, 1985

INVENTOR(S) : David R. Meintrup and Janis Dumpis

It is certified that error appears in the above-identified patent and that said Letters Patent is hereby corrected as shown below:

Column 1, line 60, "release" should be --releases--.

Column 1, line 62, "carrier" should be --substrate--.

Column 1, line 68, "can not" should be --cannot--.

Column 4, line 61, "174" should be 1/4--.

Column 4, line 66, "25b" should be --25a--.

Column 6, line 31, "ribon" should be --ribbon--.

Column 7, line 2, "provides" should be--provide--.

Column 7, line 45 (claim 1), "alternatively" should be --alternately--.

Column 8, line 2 (claim 3), "alternatively" should be --alternately--.

Column 8, line 67 (claim 12), "alternatively" should be --alternately--.

UNITED STATES PATENT AND TRADEMARK OFFICE

CERTIFICATE OF CORRECTION

PATENT NO. : 4,496,255

DATED : January 29, 1985

INVENTOR(S) : David R. Meintrup and Janis Dumpis

It is certified that error appears in the above-identified patent and that said Letters Patent is hereby corrected as shown below:

Column 10, line 7 (claim 14), "alternatively" should be --alternately--.

Signed and Sealed this

*Twenty-third* Day of *July 1985*

[SEAL]

*Attest:*

DONALD J. QUIGG

*Attesting Officer* *Acting Commissioner of Patents and Trademarks*